United States Patent [19]

Watson

[11] Patent Number: 4,531,723

[45] Date of Patent: Jul. 30, 1985

[54] PAPER SHEET SEPARATOR

[75] Inventor: Virgil A. Watson, Salem, Iowa

[73] Assignee: Metromail Corporation, Del.

[21] Appl. No.: 364,788

[22] Filed: Apr. 2, 1982

[51] Int. Cl.[3] ..... B65H 5/08

[52] U.S. Cl. ..... 271/14; 271/97; 271/99

[58] Field of Search ..... 271/97, 98, 99, 195, 271/100, 11, 14

[56] References Cited

U.S. PATENT DOCUMENTS

| | | | |
|---|---|---|---|
| 3,099,442 | 7/1963 | Wendricks et al. | 271/97 |
| 3,168,308 | 2/1965 | Walton et al. | 271/27 |
| 3,371,331 | 2/1968 | Buckholz | 271/100 X |
| 3,645,526 | 2/1972 | Holecek et al. | 271/97 |

FOREIGN PATENT DOCUMENTS

| | | | |
|---|---|---|---|
| 483855 | 12/1972 | Australia . | |
| 593995 | 2/1978 | U.S.S.R. | 271/97 |

*Primary Examiner*—Bruce H. Stoner, Jr.
*Assistant Examiner*—John A. Carroll
*Attorney, Agent, or Firm*—Harvey B. Jacobson

[57] ABSTRACT

A rigid airfoil surface and the exposed portion of the bottom sheet of a stack of flexible sheets in a magazine, form opposite passage walls of a venturi flow passage into which a flow of air is directed from a nozzle member. Collapse of the passage wall formed by the flexible bottom sheet is induced by the static suction pressure created at the throat of the venturi passage resulting in deflection of the exposed portion and separation of the bottom sheet from the stack in preparation for withdrawal by a gripper mechanism.

16 Claims, 7 Drawing Figures

PAPER SHEET SEPARATOR

BACKGROUND OF THE INVENTION

This invention relates to the separation of single sheets from a stack in preparation for withdrawal thereof during an automatic sheet handling operation.

The automatic withdrawal of single flexible sheets from a magazine stack by a mechanical gripper mechanism is well known, for example, in connection with the sheet collating operations in a "Phillipsburg Inserter". In such apparatus, the bottom sheet of the stack at a collating station is deflected by a vacuum cup device and held separated from the stack by a pivoted finger in preparation for clamping of the separated portion of the bottom sheet to a gripper lever. The bottom sheet is thereby withdrawn by the gripper lever from the magazine and dropped onto a collating conveyor. Such collating operations are shown, for example, in U.S. Pat. No. 3,371,331.

The use of pressurized air flow for sheet separation is also known, as disclosed for example in U.S. Pat. Nos. 2,743,923, 2,806,696 and 2,979,329. In all of such prior art arrangements, the reliance on a remote source of suction pressure and/or moving parts in the sheet separating operation are sources of malfunction which reduces operational reliability, calls for relatively frequent repair and maintenance, and is costly to replace and install.

It is therefore an important object of the present invention to provide a less costly, more efficient and reliable sheet separating method and apparatus which avoids the use of mechanically moving parts.

SUMMARY OF THE INVENTION

In accordance with the present invention, an airfoil member is fixedly mounted in spaced underlying relation to the exposed portion of the bottom sheet of a stack within a magazine so as to form a venturi flow passage between a rigid airfoil surface and the exposed portion of the bottom sheet. Pressurized air is timely introduced through a nozzle member into the venturi flow passage at one end so that the resulting air flow induces a static suction pressure at the throat portion of the venturi flow passage. Since one wall of the venturi flow passage is formed by the exposed portion of the flexible bottom sheet, the wall collapses under the induced suction pressure to downwardly deflect from the stack. The bottom sheet when deflected contacts spaced ribs projecting upwardly from the curved surface of the airfoil member forming the opposite rigid wall of the venturi flow passage. The ribs thus limit deflection of the bottom sheet to maintain the venturi flow passage open and divide it into flow channels through which the air flow is directed from spaced discharge orifices of the nozzle member onto the rigid airfoil surface upstream of the throat portion. The bottom sheet so deflected is engaged by the jaws of a gripper mechanism entering a recess in the airfoil member at the end of the stroke of the gripper mechanism.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 4:
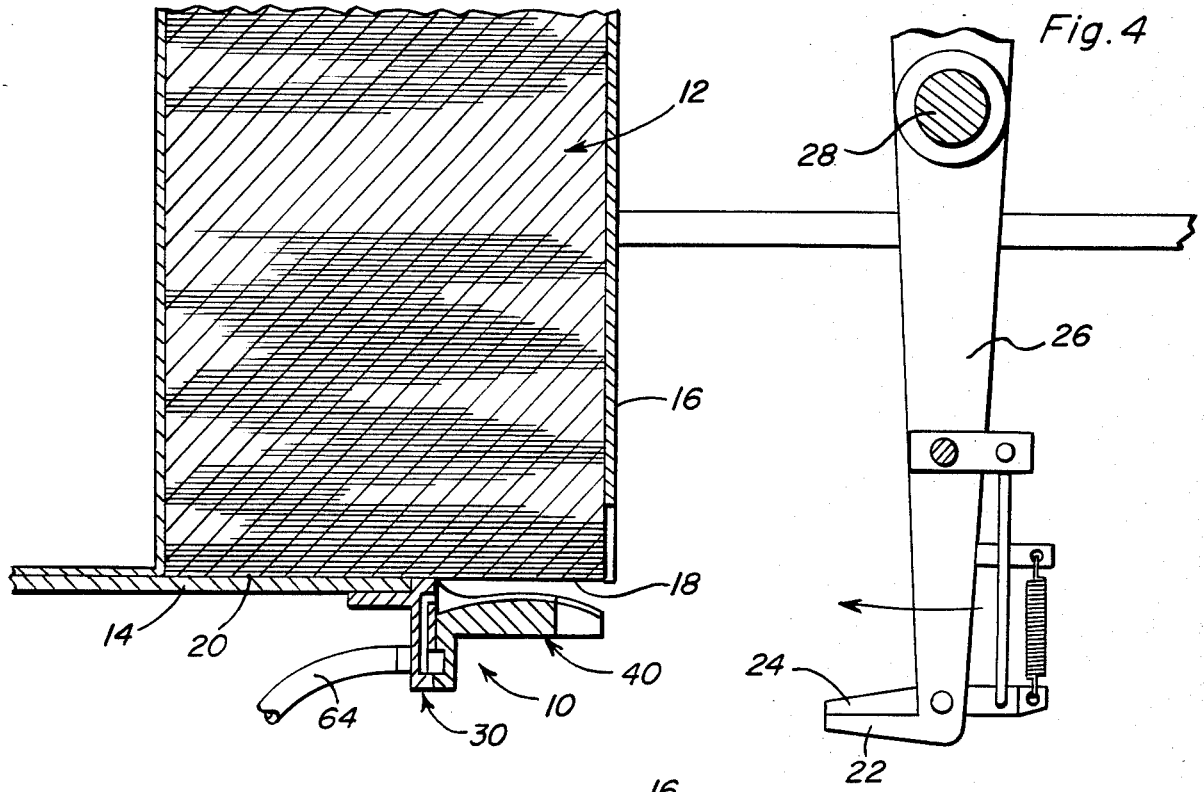
FIG. 4 is a side section view similar to FIG. 3 showing the installed sheet separating device during one phase of an operational cycle of the associated machine.

Referring now to the drawings in detail, FIG. 4 illustrates a typical installation for the sheet separating device 10 of the present invention. A vertical stack 12 of flexible paper sheets are gravitationally retained on a fixed bottom support 14 between front and rear walls of a magazine or hopper 16. A portion 18 of the bottom sheet 20 of the stack is exposed and unsupported in spaced overlying relation to the sheet separating device so that it may be deflected downwardly from the stack into operative alignment with the jaws 22 and 24 of a gripper mechanism including a gripper lever 26 pivotally mounted on a pivot shaft 28 at a collating station of a "Phillipsburg" type of machine as aforementioned. The bottom sheet 20 is thereby withdrawn from stack 12 by the gripper mechanism for deposit onto a collating conveyer (not shown).

Figure 1:
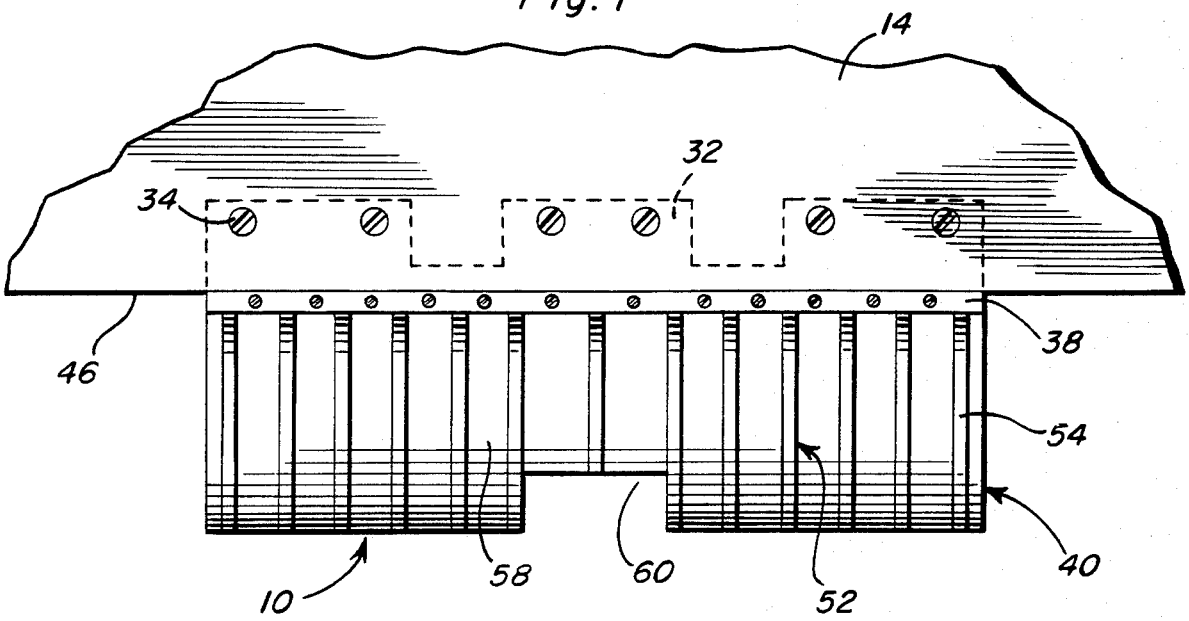
FIG. 1 is a partial top plan view showing the sheet separating device of the present invention.
Figure 2:
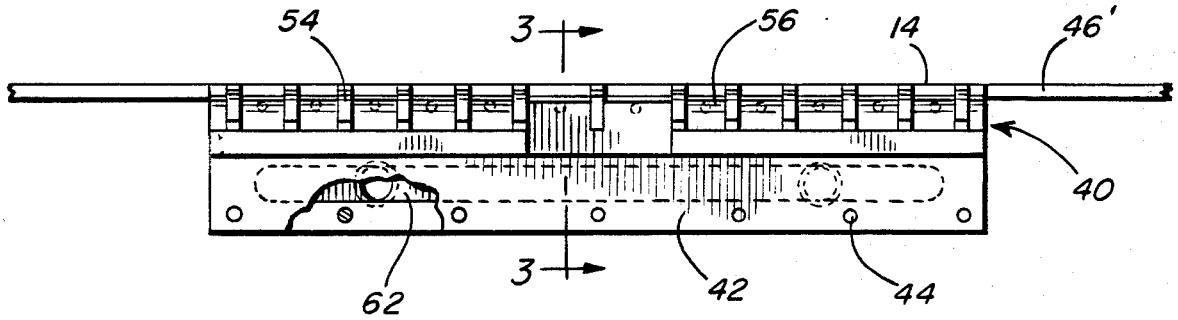
FIG. 2 is a front elevation view of the sheet separating device shown in FIG. 1.
Figure 3:
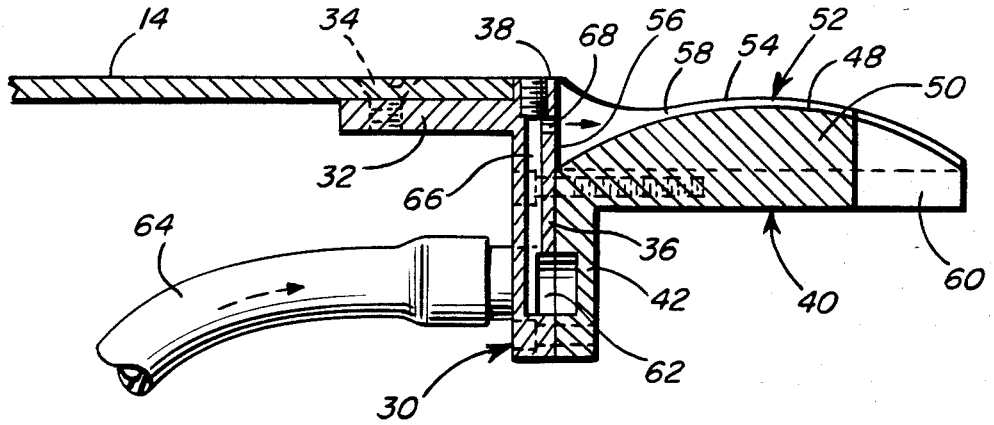
FIG. 3 is a side section view taken substantially through a plane indicated by section line 3—3 in FIG. 1.

Referring now to FIGS. 1, 2 and 3 in particular, the sheet separating device 10 includes a nozzle member 30 having an upper flange portion 32 recessed to receive the forward edge portion of bottom support 14 of the magazine to which the flange portion is secured by fasteners 34. A vertical body portion 36 of the nozzle member depends from the flange portion with its upper edge 38 flush with the upper surface of the support 14 from which the exposed portion of the bottom sheet extends in overlying relation to an airfoil member 40 of the sheet separating device.

Figure 4A:
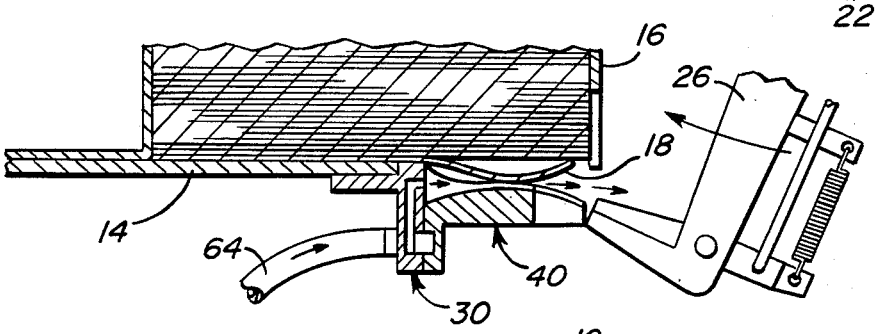
FIGS. 4*a*, 4*b* and 4*c* are section views similar to FIG. 4 showing other phases of the operational cycle.
Figure 4B:
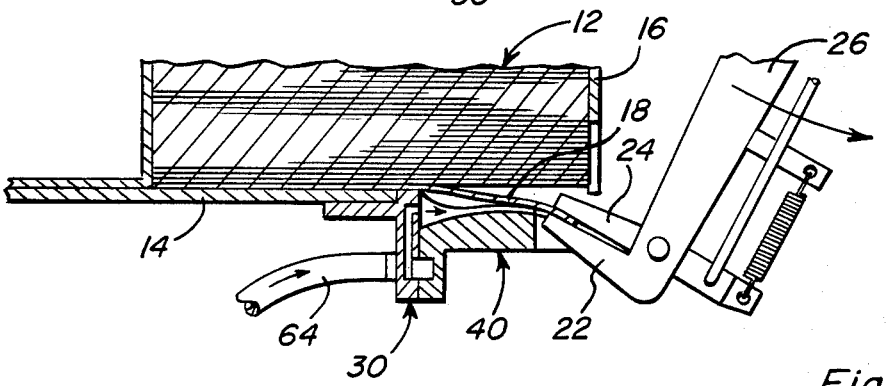

The airfoil member 40 has a depending flange portion 42 secured by fasteners 44 to the body portion 36 of the nozzle member. Both the nozzle and airfoil members extend a substantial distance along the forward edge 46 of the magazine support 14 in order to form a relatively wide venturi flow passage between the extended plane of the support 14 and a curved top surface 48 of the airfoil body portion 50 of the airfoil member. A plurality of flow directing ribs 52 project upwardly from the curved surface 48 in parallel spaced relation to each other. The upper edges 54 of the ribs extend from the upper edge 38 of the nozzle member along a rear curvature portion tangent to a forward curvature portion generally parallel to the curvature of the surface 48 when the airfoil and nozzle members are assembled as more clearly seen in FIG. 3. The curved surface 48 also extends forwardly from an exposed face 56 of the nozzle body portion and forms a rigid bottom wall of the venturi flow passage that is smooth throughout as shown. This venturi flow passage is divided into flow channels 58 between the ribs 52. A recess 60 is centrally formed between the ends of the airfoil body portion 50 to receive the jaws 22 and 24 of the gripper lever at the end of its oscillatory stroke as shown in FIG. 4*b*.

The nozzle body portion 36, as more clearly seen in FIG. 3, includes an intake manifold 62 to which pressurized air is conducted by conduits 64 from any suitable source in timed relation to the oscillatory stroke of the gripper lever 26. A plurality of passages 66 interconnect the manifold with air discharge orifices 68 on the face 56 of the nozzle body portion at one end of the venturi flow passage between the ribs 52. Accordingly, air is discharged from the nozzle orifices 68 into the flow channels 58 of the venturi flow passage as jets in a direction shown by the arrow in FIG. 3 to impinge on the curved rigid surface 48 upstream of the throat of the venturi passage and below the flexible wall formed by the exposed portion 18 of the bottom sheet overhanging the support 14.

Figure 4C:
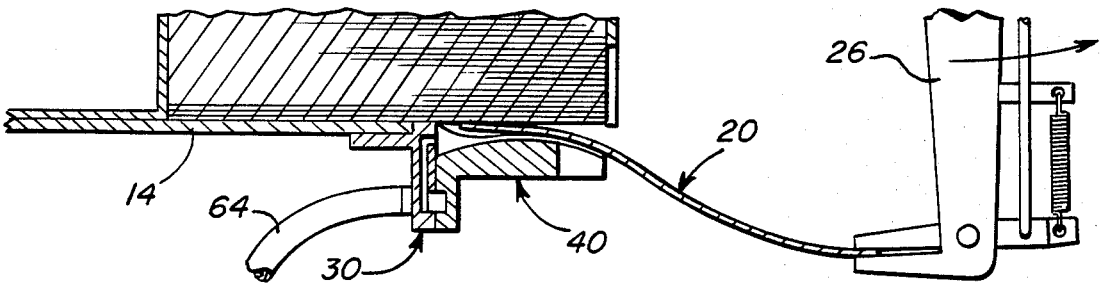

The venturi flow passage is shown in FIG. 4 prior to the introduction of pressurized air from the nozzle member 30 while the gripper lever is at an intermediate location in its oscillatory stroke moving toward the stack of sheets. When the gripper lever is approaching the stack as shown in FIG. 4*a*, pressurized air is injected into the venturi flow passage formed between the airfoil member 40 and the bottom sheet 20. The flow of air so produced in the venturi flow passage creates a static suction pressure at its throat portion spaced from the support 14 and adjacent to the front wall of magazine 16 causing the passage to collapse and the bottom sheet to deflect downwardly from the stack as shown in FIG. 4*a*. Downward deflection of the flexible bottom sheet is limited by its contact with the ribs 52 as shown to maintain the venturi passage channels open. Once the bottom sheet contacts the ribs at the throat portion of the venturi flow passage, it continues to be deflected into contact with the ribs as shown in FIG. 4*b* because of the continued inflow from the nozzle orifices 68 below the rib edges 54 as shown in FIG. 3. As the end of a gripper stroke is approached, the jaws 22 and 24 open to receive the deflected portion of the bottom sheet and close to clamp the sheet to the gripper lever. Movement of the gripper lever is then reversed in direction at the end of the stroke with the bottom sheet clamped thereto as shown in FIG. 4*c* to withdraw the bottom sheet from the stack. Flow of air from the nozzle member 30 is interrupted once the bottom sheet is clamped to the gripper lever until the next operational cycle again reaches the phase shown in FIG. 4*a*.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a magazine holding a stack of flexible sheets exposing a portion of one of the sheets for separation thereof prior to withdrawal from the stack, the improvement residing in means for deflecting said one of the sheets from the stack, comprising rigid surface means for establishing a venturi flow passage with said one of the sheets externally of the stack, nozzle means for introducing fluid under pressure into the venturi flow passage causing deflection of the one of the sheets from the stack toward the rigid surface means, and means projecting from the rigid surface means for dividing the venturi flow passage into separate flow channels.

2. The improvement as defined in claim 1 wherein said projecting means comprises ribs limiting said deflection of the one of the sheets toward the rigid surface means.

3. For use with a stack of flexible sheets retained on a fixed surface exposing an unsupported portion of the stack, means for separating the sheets from the stack, comprising airfoil means having a smooth rigid surface in spaced underlying relation to the unsupported portion of said stack for establishing a venturi flow passage therewith having a throat region, means for introducing fluid into said venturi flow passage in a discharge direction impinging the rigid surface upstream of the throat region to induce a reduction in ambient static pressure externally of the stack along said unsupported portion causing deflection of one of the sheets from the stack, and flow directing means for limiting said deflection toward the smooth rigid surface and dividing the venturi flow passage into a plurality of flow channels.

4. The combination of claim 3 wherein said fixed surface forms a bottom support on which the stack of sheets is gravitationally retained, said one of the sheets forming the bottom of the stack with the unsupported portion overlying the rigid surface of the airfoil means.

5. The combination of claim 4 wherein said flow directing means includes a plurality of spaced ribs projecting from the smooth, rigid surface toward the stack.

6. The combination of claim 5 wherein said fluid introducing means includes a nozzle member connected to the airfoil means at one end of the venturi passage, a source of air under pressure, and passage means in the nozzle member to which said source is connected for discharge into the venturi passage from said one end thereof in the discharge direction.

7. The combination of claim 6 wherein said nozzle member is provided with discharge orifices from which the air is discharged into the flow channels between the ribs.

8. The combination of claim 3 wherein said fluid introducing means includes a nozzle member connected to the airfoil means at one end of the venturi passage, a source of air under pressure, and passage means in the nozzle member to which said source is connected for discharge into the venturi passage from said one end thereof in the discharge direction.

9. The combination of claim 8 wherein said flow directing means includes a plurality of spaced ribs projecting from the smooth, rigid surface toward the stack.

10. The combination of claim 9 wherein said nozzle member is provided with discharge orifices from which the air is discharged into the flow channels between the ribs.

11. The combination of claim 3 including movable means for gripping said one of the sheets when deflected from the stack.

12. The combination of claim 11 wherein said airfoil means is provided with a recess partially overlapping the venturi passage and into which the movable gripping means is displaced to engage the deflected one of the sheets.

13. In combination with a magazine holding a stack of flexible sheets exposing a portion of one of the sheets for separation thereof prior to withdrawal from the stack, the improvement residing in means for deflecting said one of the sheets from the stack, comprising rigid surface means for establishing a venturi flow passage with said one of the sheets externally of the stack, nozzle means for introducing fluid under pressure into the venturi flow passage in a discharge direction impinging the rigid surface means to induce a static suction pressure causing deflection of the one of the sheets from the stack, and means projecting from the rigid surface means for limiting said deflection of the one of the sheets toward the rigid surface means to maintain flow of the fluid through the venturi flow passage and separation of said one of the sheets from the stack, said rigid surface means including a member having a smooth curved surface underlying the exposed portion of said one of the sheets, and said means for limiting deflection including ribs dividing the venturi flow passage into a plurality of flow channels above the curved surface.

14. The combination of claim 13 wherein said nozzle means includes a plurality of discharge orifices from which fluid is discharged into the flow channels between the ribs at one end of the venturi flow passage.

15. A method of separting flexible sheets from a stack in preparation for withdrawal from the stack by a gripper mechanism during each operational stroke thereof, including the steps of: retaining the stack with a portion thereof exposed; establishing a venturi flow passage between a rigid surface and said exposed portion; introducing pressurized air into the venturi flow passage in direction impinging the rigid surface upstream of the throat of the venturi flow passage; limiting deflection of the exposed portion toward the rigid surface to maintain the venturi flow passage open during flow of the air prior to withdrawal of the sheets; and dividing said venturi flow passage into separate flow channels, some of which overlap the stroke of the gripper mechanism.

16. In combination with a magazine holding a stack of flexible sheets exposing a portion of one of the sheets for separation thereof prior to withdrawal from the stack, the improvement residing in means for deflecting said one of the sheets from the stack, comprising rigid surface means for establishing a venturi flow passage with said one of the sheets externally of the stack, nozzle means for introducing fluid under pressure into the venturi flow passage in a discharge direction impinging the rigid surface means to induce a static suction pressure causing said deflection of the one of the sheets from the stack, and means projecting from the rigid surface means for limiting said deflection of the one of the sheets toward the rigid surface means to maintain flow of the fluid through the venturi flow passage and separation of said one of the sheets from the stack, the projecting means comprising a plurality of ribs separating flow channels in the venturi flow passage.

* * * * *